US005138943A

United States Patent [19]

Kikuchi et al.

[11] Patent Number: 5,138,943

[45] Date of Patent: Aug. 18, 1992

[54] PRESS TYPE STENCIL PRINTING DEVICE FOR POSITIONING MULTI-PRESS PRINT IMAGES

[75] Inventors: Makoto Kikuchi; Satoru Komata, both of Tokyo, Japan

[73] Assignee: Riso Kagaku Corporation, Tokyo, Japan

[21] Appl. No.: 665,247

[22] Filed: Mar. 6, 1991

[30] Foreign Application Priority Data

Mar. 12, 1990 [JP] Japan ..... 2-24696[U]

[51] Int. Cl.[5] ..... B41F 15/04

[52] U.S. Cl. ..... 101/115; 101/126; 33/616; 33/620

[58] Field of Search ..... 101/115, 126, 127.1, 101/129, DIG. 36; 248/287; 33/614, 616, 617, 620, 621, 623

[56] References Cited

U.S. PATENT DOCUMENTS 1,313,082 8/1919 Fraser ..... 33/614
2,512,937 6/1950 Hartman ..... 33/623
4,338,860 7/1982 Hamu ..... 101/126
4,485,447 11/1984 Ericsson ..... 101/129
4,679,501 7/1987 Hanash ..... 101/114
4,846,058 7/1989 Farris ..... 101/126

FOREIGN PATENT DOCUMENTS 438919 12/1926 Fed. Rep. of Germany ..... 33/620

*Primary Examiner*—Edgar S. Burr
*Assistant Examiner*—Stephen R. Funk
*Attorney, Agent, or Firm*—Stevens, Davis, Miller & Mosher

[57] ABSTRACT

In a press type stencil printing device in which a press plate holding a stencil printing plate is pivotably mounted to a base carrying a print sheet receiver placed thereon so that the stencil printing plate is pressed onto a print sheet placed on the print sheet receiver, a transparent or semi-transparent positioning print sheet is pivotably mounted to be selectively overlapped on the print sheet receiver, and the print sheet receiver is fastened to the base by a fastener which allows minute adjustment of the printing sheet receiver in two dimensions on the base relative thereto.

3 Claims, 2 Drawing Sheets

PRESS TYPE STENCIL PRINTING DEVICE FOR POSITIONING MULTI-PRESS PRINT IMAGES

BACKGROUND OF THE INVENTION

1. Field of the Invention

The present invention relates to the art of stencil printing, and more particularly, to a handy press type stencil printing device of a type which performs stencil printing with a stencil printing plate composed of a stencil sheet, a frame supporting peripheral portions of the stencil sheet and an ink-impermeable sheet adapted to hold a quantity of ink between itself and said stencil sheet.

2. Description of the Prior Art

A handy press type stencil printing device for performing stencil printing with the stencil printing plate as described above has been proposed by the same assignee as that of the present application in Japanese Utility Model Publication 57-15814, and is now sold under the trademark "PRINT GOCCO" as a stencil printing device convenient for printing new year cards or the like.

By using such a press type stencil printing device with the stencil printing plate as described above it is possible to obtain a multi-color print image by a one time pressing operation when various parts of the image in the stencil sheet are supplied with relatively less fluidal inks of different colors. However, since it is difficult to finely and precisely define the border between two adjacent layers of inks of different colors supplied side by side on the stencil sheet, the quality in the sense of beautifulness of the multi-color print images available by such a method is limited. Therefore, in order to obtain color prints having much higher quality it is required that a multi-overlap printing be used which repeats the printing operation several times in various colors one over the other.

Such a multi-overlap printing can be performed by employing the above-mentioned press type stencil printing device in such a manner that several stencil printing plates are prepared to correspond to respective images to be overlapped several times by the press printing operation. However, in such an overlap printing it is crucial that the respective print images to be overlapped are correctly positioned.

SUMMARY OF THE INVENTION

It is the object of the present invention to provide a press type stencil printing device for performing a handy stencil printing as described above in such a structure to make it possible to correctly adjust the positioning of the images to be overlapped by such a multi-press printing.

According to the present invention the above-mentioned object is accomplished by a press type stencil printing device comprising a base having a plane upper surface, a print sheet receiving means placed on said upper surface of said base to be freely slidable thereon, a press plate means mounted to said base to be pivotable between a position where said press plate means lies over said printing sheet receiving means and a position apart from said print sheet receiving means and having a means for holding a stencil printing plate at a face thereof confronting said print sheet receiving means, a fastening means for fastening said print sheet receiving means to said base at a position minutely adjustable along said upper surface of said base in two dimensional directions relative to said base, and at least one transparent or semi-transparent positioning print sheet means mounted to said base to be pivotable between a position where said positioning print sheet means lies over said print sheet receiving means and a position apart from said print sheet receiving means.

The press type stencil printing device of the above-mentioned construction may be used as follows: First, a required number of printed sheets are produced by employing a first stencil printing plate. Then, prior to applying a second print image by a second stencil printing plate on the first printed sheets, said positioning print sheet means is pivoted to be laid over the print sheet receiving means with or without one of the first printed sheets placed thereon, and a second printing operation by the second stencil printing plate is applied onto the positioning print sheet means. Then, with one of the first printed sheets being placed on the print sheet receiving means as correctly positioned thereto, such one said first printed sheet being now placed on the print sheet receiving means if it has not yet been placed thereon, it is readily confirmed if the second image provided on the transparent or semi-transparent positioning print sheet means laid over said first printed sheet is correctly positioned relative to said first printed image already provided on said first printed sheet. Therefore, if the first and second printed images are not correctly positioned relative to one another, then said fastening means is temporarily unfastened, then the position of said print sheet receiving means relative to said base is adjusted so that said first and second images are correctly positioned relative to one another, and then the fastening means is again fastened. Thereafter, the printed sheets may be applied with the second printing operation by the second stencil printing plate as overlapped on said first printed image. The print sheets will now bear a multi-print image in which the two printed images are correctly positioned relative to one another.

The positioning print sheet means for the above described functions may be provided in a quantity of as many as desired up to four so as to be arranged along four sides of a generally rectangular configuration of said base. When four such positioning print sheet means are provided, a multi-print image consisting of five overlapped images is available without exchanging the positioning print sheet means. However, as will be noted in the embodiment described hereinunder, since the positioning print sheet means can be so construced that it is readily mounted to and dismounted from the base, an embodiment having only one means for pivotably mounting the positioning print sheet means along one side of the base of a rectangular configuration is substantially effective to produce any optional number multi-print image with preparation of the required number of positioning print sheet means. Further, the positioning print sheet means may be formed of a plastic plate having a smooth surface which bears images by ink in a manner to readily allow the images to be cleaned away by washing after its use so that a single such positioning print sheet means is substantially effective for producing any optional number of multi-print images.

Said base may bear a pair of rod supports and a rod supported by said rod supports at opposite ends thereof, and said positioning print sheet means may be pivotably and removably mounted to said rod by a pair of clamp portions thereof.

Said fastening means may comprise a pair of securing elements mounted to said print sheet receiving means, said securing elements each providing a first plate means extending in parallel to said upper surface of said base and having an elongated opening extending in a first direction, a pair of support elements mounted to said base, said support elements each providing a second plate means extending in parallel to said upper surface of said base and having an elongated opening extending in a second direction substantially perpendicular to said first direction, said elongated opening in each said securing element partly overlapping said elongated opening in each said support element, and a pair of bolt-nut assemblies, each said bolt being passed through overlapping portions of said elongated opening of said securing element and said support element and engaged with each said nut so as to selectively clamp said securing element and said support element to one another.

BRIEF DESCRIPTION OF THE DRAWINGS

In the accompanying drawings.

DESCRIPTION OF THE PREFERRED EMBODIMENT

In the following the present invention will be described in detail with respect to an embodiment thereof with reference to the accompanying drawings.

Figure 1:
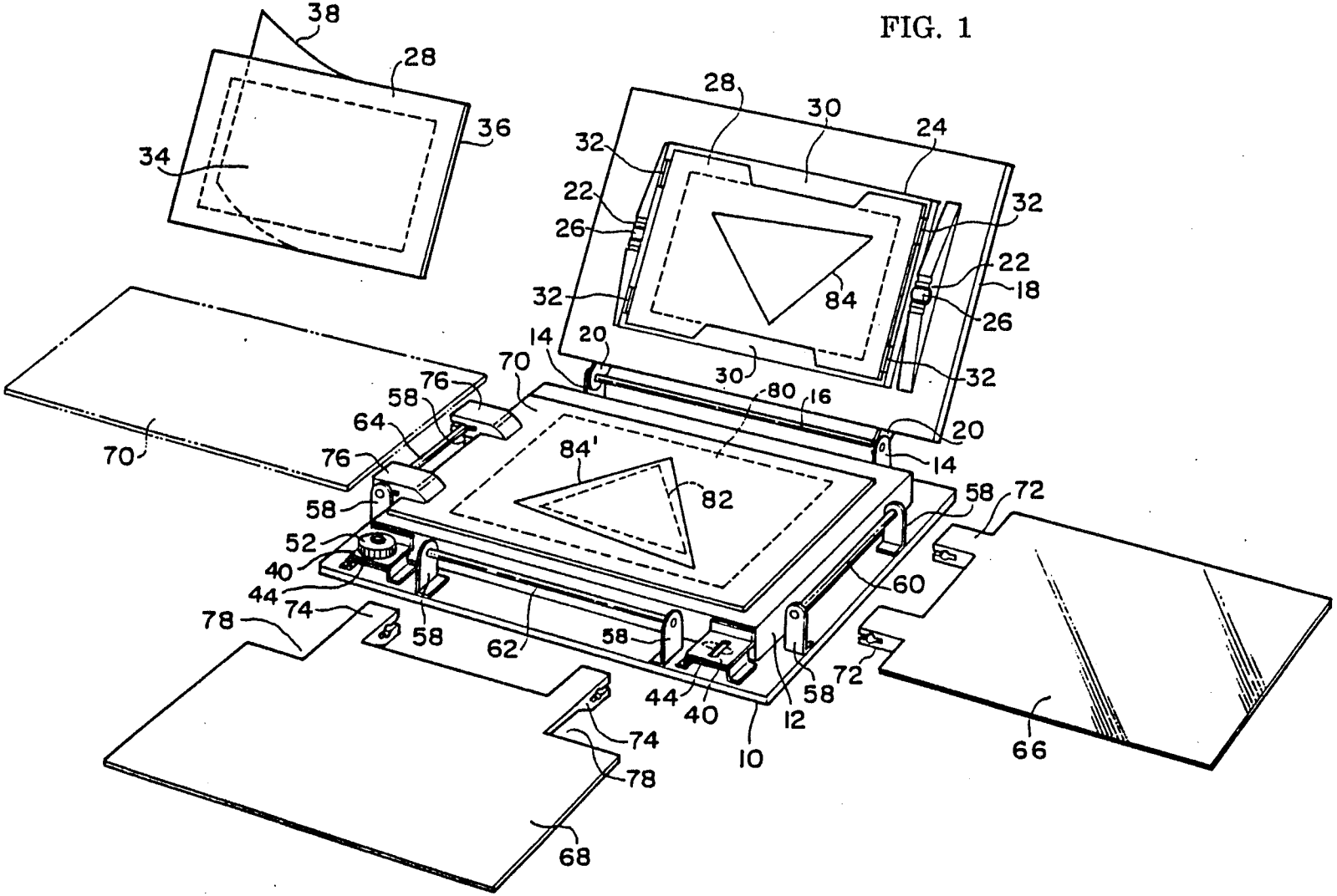
FIG. 1 is a perspective view showing an embodiment of the press type printing device according to the present invention.

Referring to FIG. 1 showing an embodiment of the press type stencil printing device according to the present invention in a perspective view, 10 designates a base adapted to be placed on a plane horizontal surface such as a desk top. On a plane upper surface of the base 10 there is placed a print sheet receiving means 12 so as to be freely slidable. Further, a pair of rod supports 14 are mounted to the base 10 so as to support a press plate means 18 via a rod 16 to be pivotable therearound. The press plate means 18 is a plate member as shown in the figure and has a pair of securing elements 20 for pivotal engagement with said rod 16.

The press plate means 18 has a pair of flexible bearing grooves 22. A stencil printing plate supporting means 24 having the configuration of a plate member is mounted to the press plate means 18 with a pair of stud shafts 26 extending from opposite sides thereof being engaged into the flexible grooves 22 so that the stencil printing plate supporting means 24 is slightly tiltable around the central axis of the stud shafts 26 relative to the press plate means 18.

The stencil printing plate supporting means 24 has a pair of tongues 30 for holding a stencil printing plate 28 and four projections 32 for stopping the stencil printing plate 28 held by the tongues 30 against movement in opposite directions along the tongues 30.

The stencil printing plate 28 has a structure as shown separately in the figure on the left side of the press plate means 18, wherein it comprises a thermal stencil sheet 34 made of a thermally fusible plastic film and a Japanese paper or a net material pasted together, an annular frame element 36 made of a cardboard and supporting peripheral portions of the thermal stencil sheet 34 as attached on one face thereof, and an ink-impermeable sheet 38 also supported by the annular frame element 36 as attached on the other face thereof with only a part of its peripheral portions being pasted to the annular frame element 36. The stencil printing plate may be the conventional one which is used with the above-mentioned "PRINT GOCCO", or may have the structure proposed in Japanese Patent Application 1-117434 or 1-117435 (these two applications are the priority bases for U.S. Pat. No. 5,054,391 issued Oct. 8, 1991) filed by the same assignee as that of the present application for use with a word processor having a thermal printing head to be perforated thereby, in which the thermal stencil sheet 34 is temporarily removable from the annular frame element 36. Further, the perforation of the stencil printing sheet may be done by any known means such as the above-mentioned "PRINT GOCCO" or word processors having thermal printing heads.

Figure 2:
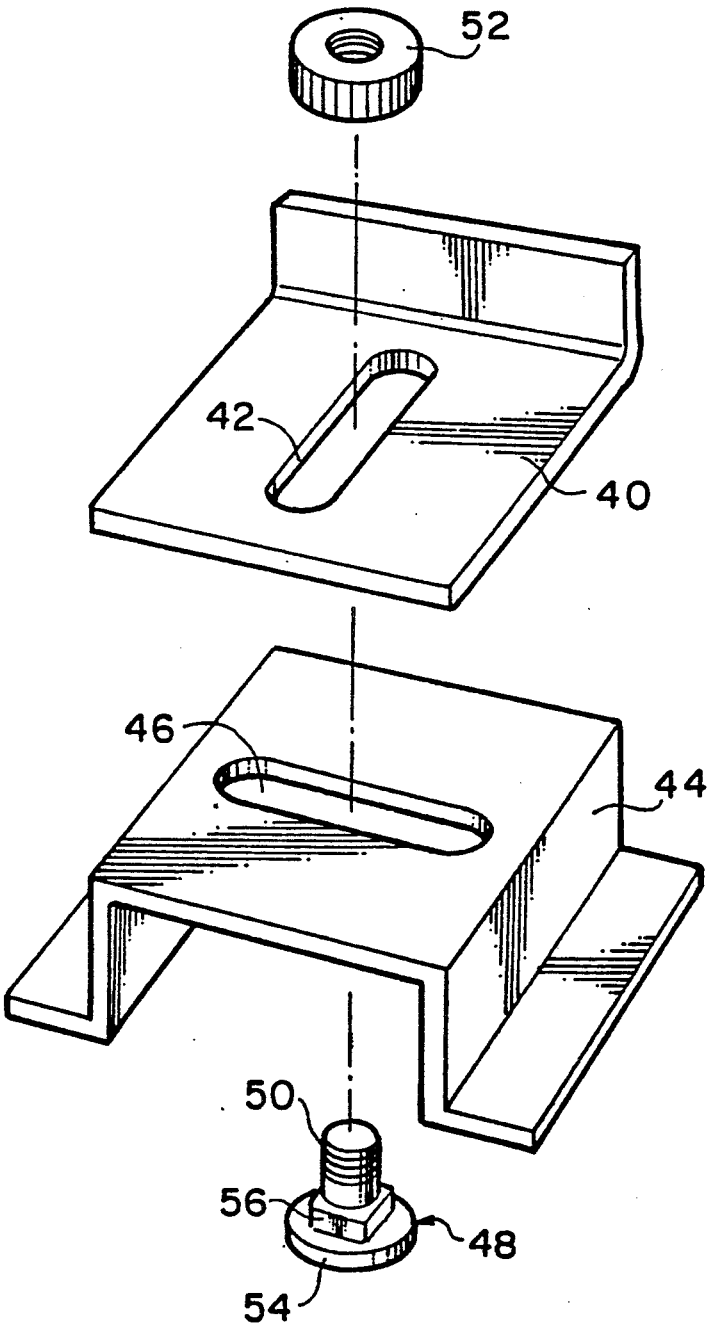
FIG. 2 is a perspective view showing a part of the device shown in FIG. 1 in an enlargement.

The print sheet receiving means 12 placed on the plane upper surface of the base 10 to be freely slidable thereon has securing elements 40 mounted thereto at opposite end portions of one side thereof, each providing a first plate means formed with an elongated opening 42 as shown in more detail in FIG. 2. On the other hand, on the base 10 there are mounted a pair of support elements 44, each being made of a plate element folded into a stand shape to be positioned below the securing element 40 in an overlapping manner at a portion thereof providing a second plate means which confronts said first plate means and is formed with an elongated opening 46 extending in a direction perpendicular to the elongated opening 42 of the securing element 40. A screw 48 is passed through the elongated openings 42 and 46 of the overlapped securing element 40 and the support element 44 from the underside thereof upward so that its thread portion 50 engages with a nut 52 provided thereon. The screw 48 has a head portion 54 and a root portion 56 having a square cross section adapted to engage into the elongate opening 46 of the support element 44 in a manner to allow the screw 48 to move along the elongate groove 46 while the screw is held against rotation when the nut 52 is fastened to or unfastened from the screw 48.

Thus, the securing elements 40 mounted to the print sheet receiving means 12, the support elements 44 mounted to the base 10, the screws 48 passed through the crossed elongated openings 42 and 46 of the securing elements and the support elements, and the nuts 52 construct a fastening means for fastening the print sheet receiving means 12 to the base 10 with an adjustable relation therebetween. This fastening means, when the nuts 52 are unfastened so that relative movements between the securing elements 40 and the support elements 44 are allowed, allows the position of the print sheet receiving means 12 to be minutely adjusted relative to the base 10 in two dimensions along the upper surface of the base. The functions and effects of such minute adjustment will be described hereinunder.

On the base 10 there are mounted three pairs of rod supports 58 of the same or similar structure as the rod supports 14 to support three rods 60, 62 and 64 of the same or similar configuration as the rod 16, respectively. Three positioning print sheet means 66, 68 and 70, each being substantially a plate element made of a transparent or semi-transparent material, are readily removably and pivotably mounted to the rods 60, 62 and 64 with each pair of clamp portions 72, 74 and 76 provided at one side portion thereof engaging with said rods, respectively. In the figure the positioning print sheet means 66 and 68 are shown as dismounted from the rods 62 and 64 for the purpose of clarity of illustration, and the positioning print sheet means 70 is shown as mounted to the rod 64 with its clamp portions 76 and laid with its principal portion over the print sheet receiving means 12. As will be noted in the figure, the positioning print sheet means 68 is cut off at portions 78 so that, when it is mounted to the rod 62 with its clamp portions 74 and pivoted to be laid over the print sheet receiving means 12 with its principal plate portion, it does not interfere with the manipulation of the nuts 52 of the fastening means.

Another positioning print sheet means similar to the positioning print sheet means 68 may be provided to be mounted to the rod 16 for the press plate means 18, though such an additional positioning print sheet means is not shown in the figure.

The manner of performing a multi-color printing operation by the above described press type printing device will be described hereinunder.

It is assumed that a print sheet 80 is placed on the print sheet receiving means 12 as shown by a broken line in the figure, the positioning print sheet means 70 is placed on the print sheet 80, the print sheet 80 has been printed with a triangle print image 82 by another stencil printing plate, and the stencil printing plate 28 is expected to print a triangle print image on the print sheet 80 with its perforated portion 84 as overlapped on the triangle print image 82. Now, first, the press plate means 18, with the stencil printing plate 28 mounted thereto, is pressed on the positioning print sheet means 70 overlapped on the print sheet 80 so as thereby to print a triangle print image 84' on the positioning print sheet means 70. Then, if the triangle print image 84 should be so positioned relative to the triangle print image 82 that the three sides of the former are parallel to those of the latter, respectively, then the nuts 52 are unfastened, then the print sheet receiving means 12 is appropriately moved on the base 10 until the triangle print images 82 and 84' are positioned as required relative to one another, and then the nuts 52 are again fastened. After such an adjustment procedure, when print sheets such as the print sheet 80 bearing the triangle print image 82 are correctly positioned relative to the print sheet receiving means 12 as predetermined therefor in the subsequent overlap printing by the stencil printing plate 28, it is ensured that the second triangle print image is always correctly positioned relative to the first triangle print image.

The positioning procedure in the manner described above may be performed only once prior to the overlap printing by the stencil printing plate 28, or may be performed every time when such an overlap printing is performed as preceding thereto. When three positioning print sheet means are provided as in the embodiment shown in the figure, four press overlap printing is available with appropriate adjustments of relative positions among respective printing images without such troubles as dismounting, cleaning and re-mounting the positioning print sheet means.

Although the present invention has been described in detail with respect to an embodiment thereof in the above, it will be apparent to those skilled in the art that various other embodiments are possible within the scope of the present invention.

We claim:

1. A press type stencil printing device comprising:

a base having an upper surface forming a plane;

a print sheet receiving means having a shape of a substantially rectangular plate and placed on said upper surface of said base to be freely slidable thereon;

a press plate means mounted to said base to be pivotable between a position where said press plate means lies over said print sheet receiving means and a position apart from said print sheet receiving means and having a means for holding a stencil printing plate at a face thereof confronting said print sheet receiving means;

at least one transparent or semitransparent positioning print sheet means;

means for mounting said positioning print sheet means to said base to be pivotable between a position where said positioning print sheet means lies over said print sheet receiving means and a position apart from said print sheet receiving means, said mounting means including a pair of rod supports standing substantially vertically from said base, a rod supported by said rod supports at opposite ends thereof, and a pair of clamp means integrally connected to said positioning print sheet means, said pair of clamp means being removably mounted to said rod to be rotatable therearound; and means for fastening said print sheet receiving means to said base at a position minutely adjustable along said upper surface of said base in two dimensions relative to said base, said fastening means including a pair of securing elements mounted to said print sheet receiving means so as to provide a pair of first plate means extending in parallel to said upper surface of said base and each having an elongated opening extending in a first direction, a pair of support elements mounted to said base so as to provide a pair of second plate means extending in parallel to said upper surface of said base and overlying said first plate means, each support element having an elongated opening extending in a second direction substantially perpendicular to said first direction so that said elongated opening in each said securing element partly overlie said elongated opening in each said support element, and a pair of bolt-nut assemblies with each said bolt being passed through the overlying portions of said elongated openings of said securing element and said support element and engaged with each said nut so as to selectively clamp said securing element and said support element to one another.

2. The press type stencil of claim 1 in which said base is rectangular with four sides and a pair of rod supports and a rod mounted on said rod support on each of said four sides; said press plate means being pivotally mounted on one of said rods.

3. The press type stencil of claim 2 in which the arrangement of said rods is such that a positioning print sheet means may be pivotally mounted to any one of the rods, including the rod upon which the press plate means is mounted.

* * * * *